US006161987A

United States Patent [19]

Holmes et al.

[11] Patent Number: 6,161,987

[45] Date of Patent: Dec. 19, 2000

[54] RETAINER DEVICE FOR PAVING SCREED EXTENSIONS

[75] Inventors: Ted E. Holmes; Brian S. Hawkins, both of Mattoon, Ill.

[73] Assignee: Blaw-Knox Construction Equipment Co., Mattoon, Ill.

[21] Appl. No.: 09/364,836

[22] Filed: Jul. 30, 1999

Related U.S. Application Data

[60] Provisional application No. 60/094,761, Jul. 31, 1998.

[51] Int. Cl.[7] ..... E01C 19/22

[52] U.S. Cl. ..... 404/104; 404/118

[58] Field of Search ..... 404/96, 104, 118, 404/119, 120

[56] References Cited

U.S. PATENT DOCUMENTS 4,818,140 4/1989 Carlson ..... 404/118

6,022,170 2/2000 Rower ..... 404/96

*Primary Examiner*—Eileen D. Lillis

*Assistant Examiner*—Gary S. Hartmann

*Attorney, Agent, or Firm*—Mark A. Ussai

[57] ABSTRACT

A retainer device is used with a screed assembly including a main screed and a pair of front-mounted screed extensions connected with the main screed. Each extension is pivotally attached to the main screed and has a front surface facing generally away from the main screed. The retainer device includes a retainer plate disposed adjacent to the front surface of the screed extension. A horizontally-extending rod has a first end connected with the retainer plate and a second end connected with the main screed. The rod is configured to displace the retainer plate between a first, most distal position with respect to the main screed and a second, most proximal position with respect to the main screed. At the most proximal position, the retainer member acts upon the screed extension such that the screed extension is retained generally in contact with the main screed. Further, the plate prevents rotation of the screed extension in a direction generally away from the main screed.

11 Claims, 5 Drawing Sheets

RETAINER DEVICE FOR PAVING SCREED EXTENSIONS

BACKGROUND OF THE INVENTION

This application claims the benefit of U.S. Provisional Application No. 60/094,761, filed Jul. 31, 1998.

The present invention relates to paving machines, and more particularly to paving screeds having screed extensions and strike-off devices.

Screed assemblies 1 used with paving machines to level paving material, typically asphalt, applied by the machine onto a generally horizontal base surface 2 are well known, an example of such being depicted in FIGS. 1 and 2. Such screed assemblies 1 often include both a main screed 3 and one or more pairs of screed extensions 4 connected with the main screed 3. Typically, the screed assembly 1 is movably attached to the main frame or chassis of the paver (not shown) by means of a pair of rotatable arms (not depicted) that extend between the main screed 3 and the paver frame. The screed extension 4 may either be fixedly attached (e.g., bolted) to an end of the main screed 3 (or an outer end of another screed extension 4) or movably attached to the main screed 3. Movably attached screed extensions 4 are commonly referred to as "extendible screeds" and are laterally displaceable with respect to the main screed 3, typically by means of hydraulic cylinders (not shown) so as to either be extended outwardly beyond the outer ends of the main screed 3 or retracted into centralized positions. Both types of screed extensions 4 enable the screed assembly 1 to be adjusted for use in paving different base surfaces 2 of various widths.

Further, screed assemblies 1 having one or more strike-off devices 5 disposed frontwardly (i.e., with respect to the direction of paving machine travel 11) of the screed sections 3, 4 are also known. The strike-off member/plate 5 has a working edge 5*a* at the lower end of the plate 5 which establishes a first height/thickness of paving material prior to leveling by the working surfaces of the screed assembly 1. Typically for front-mounted screed extensions 4, both the screed extension 4 and the strike-off plate 5 (generally two plates 5) are each mounted to a pair of laterally spaced support members 7 attached to the upper surface of the main screed 3. As best shown in FIG. 2, the screed extensions 4 are attached to the support members 7 by the engagement of two laterally spaced posts 8 on the extension 4 with a separate bushing 9 on each of the support members 7. As there is a certain amount of clearance or "play" between the post 8 and bushing 9 and the points of connection are laterally spaced, the screed extensions 4 are pivotable to a certain extent with respect to the support members 7, and thus the main screed 3, at about the points P as indicated in FIG. 2.

Certain problems with screed assemblies 1, as described above, arise due to the capability of the screed extensions 4 to pivot frontwardly with respect to the main screed 3. When a paver is being transported between paving operations, the screed assembly 1 is moved vertically upward into a transport position by pivoting the above-described attachment arms upwardly about an axis on the paver (not shown). When the main screed 3 is moved upwardly, the screed 3 rotates with the pivoting movement of the attachment arms such that the front vertical surface 3*a* thereof faces generally downwardly. However, the weight of the screed extensions 4, held to the support members 7 primarily by the post/bushing connections described above, cause the extensions 4 to rotates frontwardly away from the main screed 3.

The movement of the screed extensions 4 frontwardly away from the main screed 3 causes the screed extensions 4 to contact and bend the lower portion of the strike-off plate 6 frontwardly. Further, due to the motion of the paver during transport, the screed extensions 4 tend swing in an oscillatory manner about the pivot points P, such that the rear surface 4*a* of the extensions 4 tend to repeatedly impact with the front surface 3*a* of the main screed 3. These repeated impacts may cause damage to components of the main screed 3 and/or the screed extensions 4, and thus adversely affect the performance of the screed assembly 1 during paving operations.

Therefore, it is desirable to provide a screed assembly with means to retain the screed extensions disposed proximal to the main screed, particularly during transportation of the paver, to prevent the damage and adverse effects described above.

SUMMARY OF THE INVENTION

In one aspect, the present invention is a retainer device for a screed assembly. The screed assembly include a main screed and a front-mounted screed extension connected with the main screed. The screed extension has a front surface facing generally away from the main screed. The retainer device comprises a retainer member disposed adjacent to the front surface of the screed extension. A connective member has a first end connected with the retainer member and a second end connected with the main screed. The connective member is configured to displace the retainer member between a first, most distal position with respect to the main screed and a second, most proximal position with respect to the main screed. At the second position, the retainer member acts upon the screed extension such that the screed extension is retained generally in contact with the main screed.

In another aspect, the present invention is a retainer device for a screed assembly. The screed assembly include a main screed and a front-mounted screed extension pivotally attached to the main screed. The screed extension has a front surface facing generally away from the main screed. The retainer device comprises a horizontally-extending rod having a rear end connected with the main screed and a front end. A plate is connected with the front end of rod and is disposed adjacent to the front surface of the screed extension. The plate prevents rotation of the screed extension in a direction generally away from the main screed.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
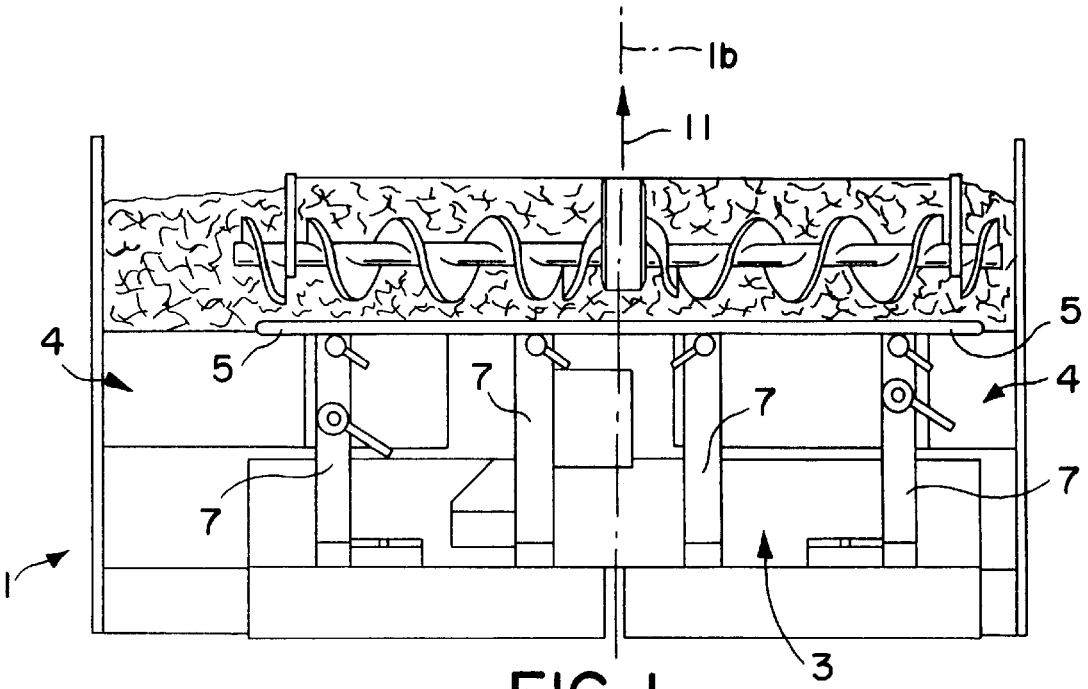
FIG. 1 PRIOR ART
FIG. 1 is a top elevational view of a typical screed assembly having a known strike-off device.
Figure 2:
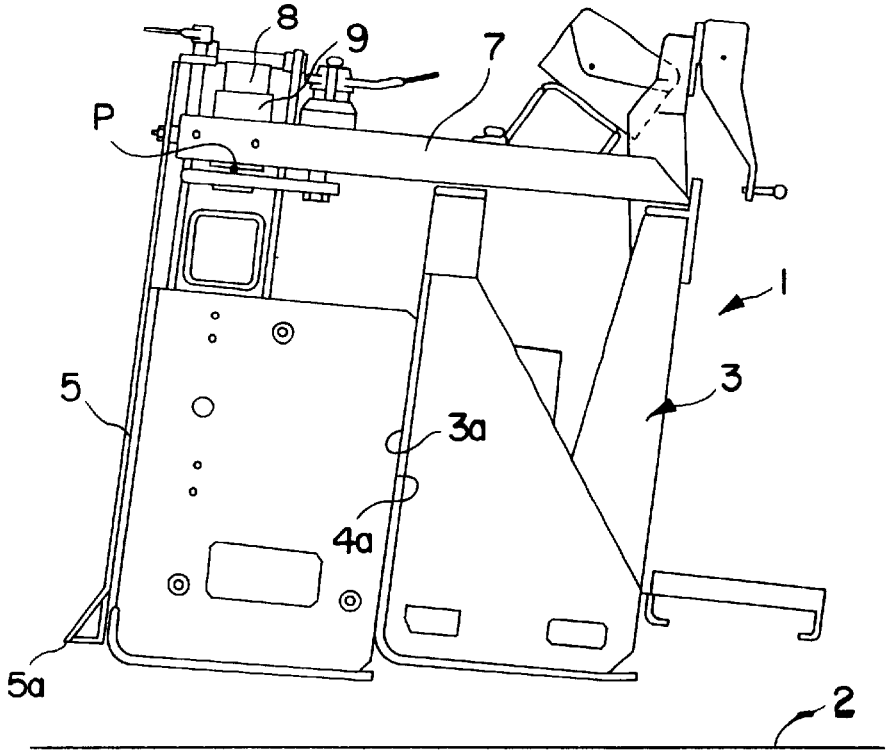
FIG. 2 PRIOR ART
FIG. 2 is a side elevational view of the screed assembly of FIG. 1.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, a designated front section of a screed assembly, a retaining device or a specific portion of either, the particular meaning intended being readily apparent from the context of the description. The words "inner", "inward"and "outer", "outward" refer to directions toward and away from, respectively, longitudinal center line 1*b* of the screed assembly. The terminology includes the words specifically mentioned above, derivatives thereof, and words of similar import.

Referring now to the drawings in detail, wherein like numbers are used to indicate like elements throughout, there is shown in FIGS. 3–8 a retainer device 10 in accordance with the present invention. The retainer device 10 is intended for use with a screed assembly 1 including a main screed 3 and a front-mounted screed extension 4 connected with the main screed 3. The screed extension 4 has a front surface 4*b* facing generally away from the main screed 3.

The retainer device 10 basically comprises a retainer member 12 disposed adjacent to the front surface 4*b* of the screed extension 4. A connective member 14 has a first end 14*a* connected with the retainer member 12 and a second end 14*b* connected with the main screed 3. The connective member 14 is configured to displace the retainer member 12 between a first, most distal position with respect to the main screed 3 and a second, most proximal position with respect to the main screed 3 where the retainer member 12 acts upon the screed extension 4 such that the screed extension 4 is disposed proximal to the main screed 3. Further, the retainer member 12 prevents rotation of the screed extension 4 in a direction generally away from the main screed 3. Each of the above-recited primary elements of the retainer device 10 is described in further detail below.

Figure 3:
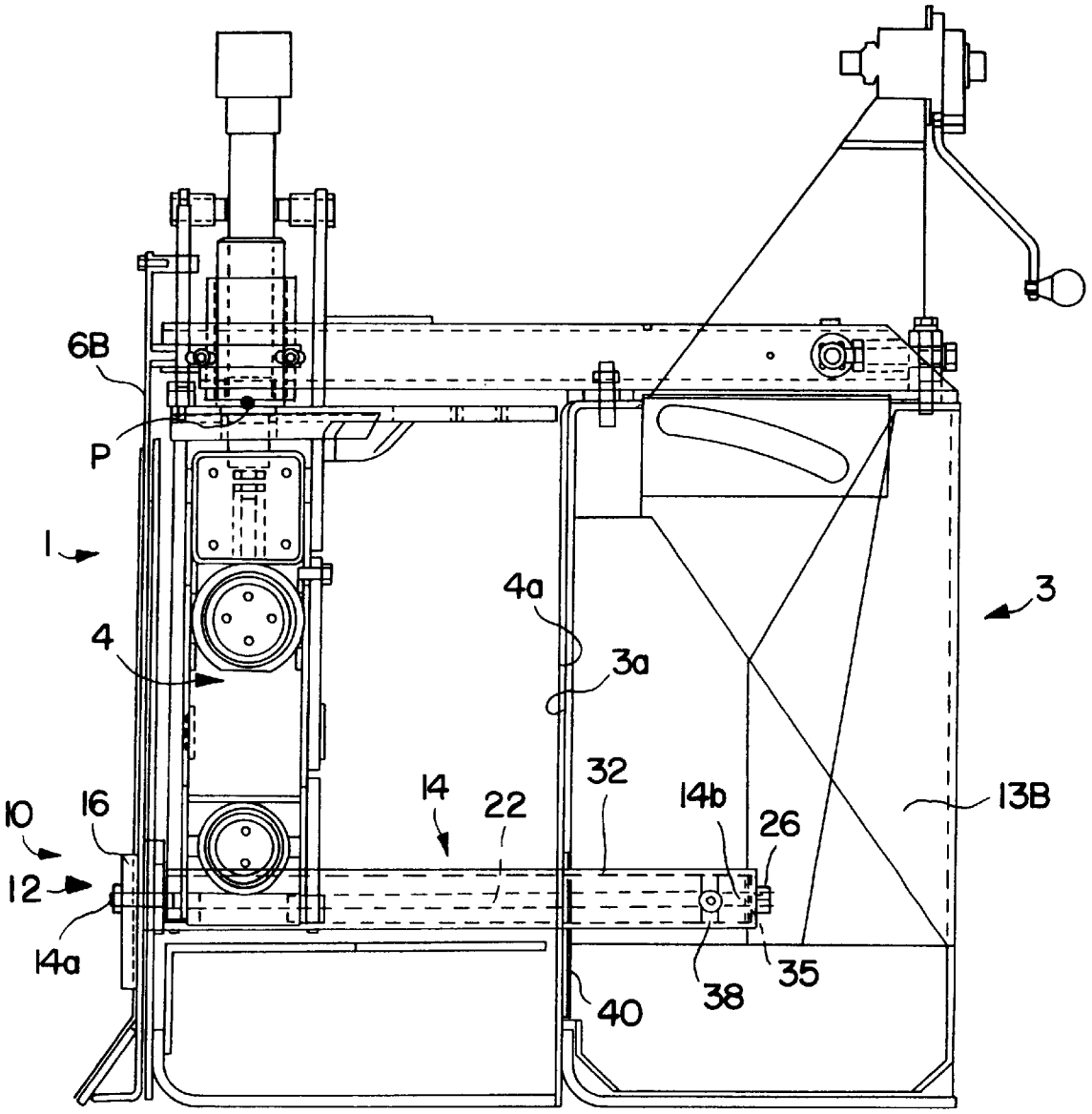
FIG. 3 is a side elevational view of a screed assembly having a retainer device in accordance with the present invention.

Before describing the retainer device 10 in further detail, it is beneficial to describe certain features of the screed assembly 1 with which the retainer device 10 is preferably used for use with which the Referring to FIGS. 1 and 3, the screed assembly 1 is preferably constructed generally similarly to known screed assemblies 1 as discussed in the Background section of the present disclosure. The screed assembly 1 thus preferably includes two screed extensions 4 attached to the main screed 3, each screed extension 4 being laterally displaceable along the front surface 3*a* of the main screed 3 in the manner of front-mounted "extendible screeds". Further, the preferred screed assembly 1 further includes a pair of strike-off plates 6A, 6B, each being disposed frontwardly of a separate screed extension 4 and connected with either the main screed 3 (by attachment to the support arms 7) or to the proximal screed extension 4.

Figure 4:
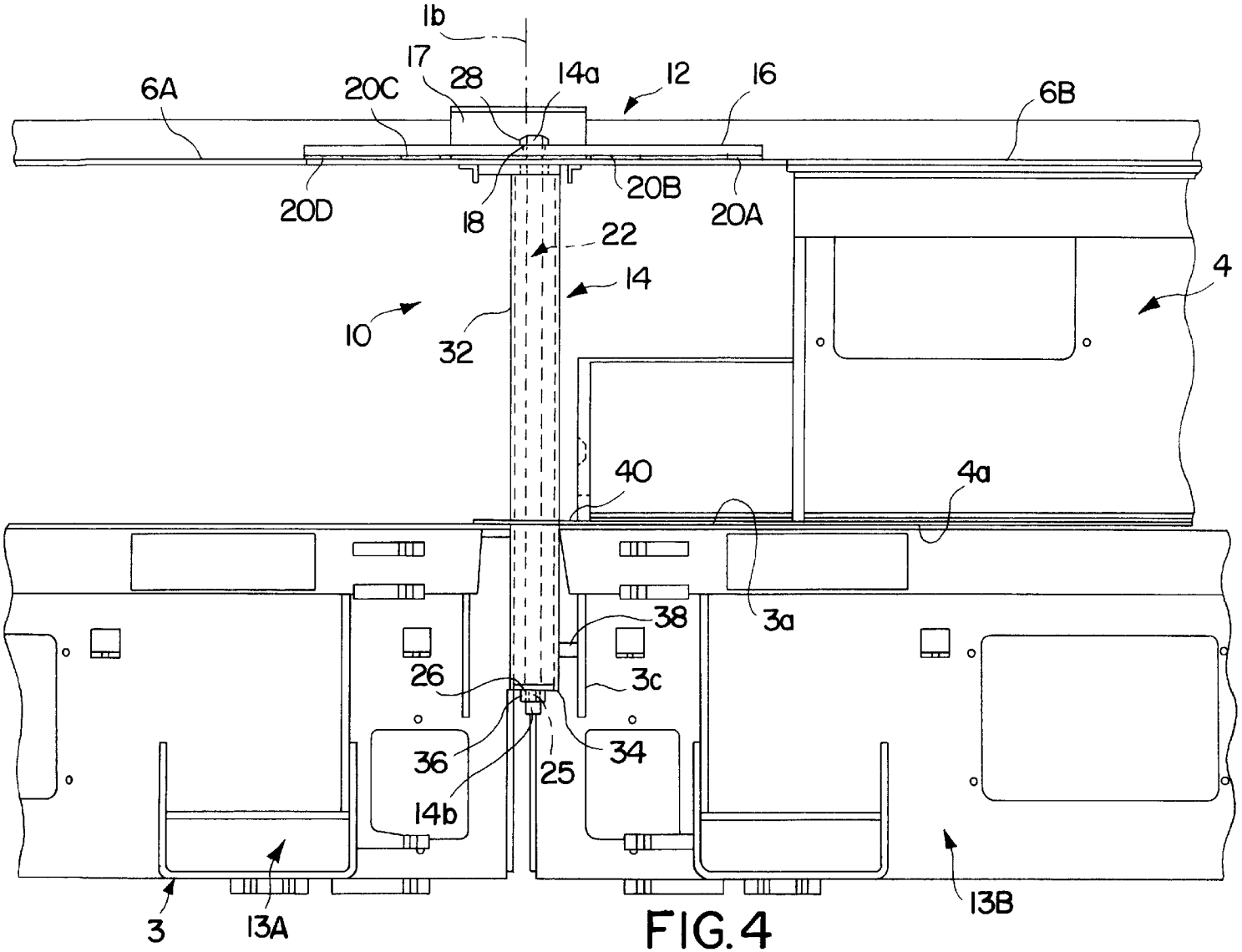
FIG. 4 is a broken-away, top plan view of a screed assembly having the retainer device.
Figure 5:
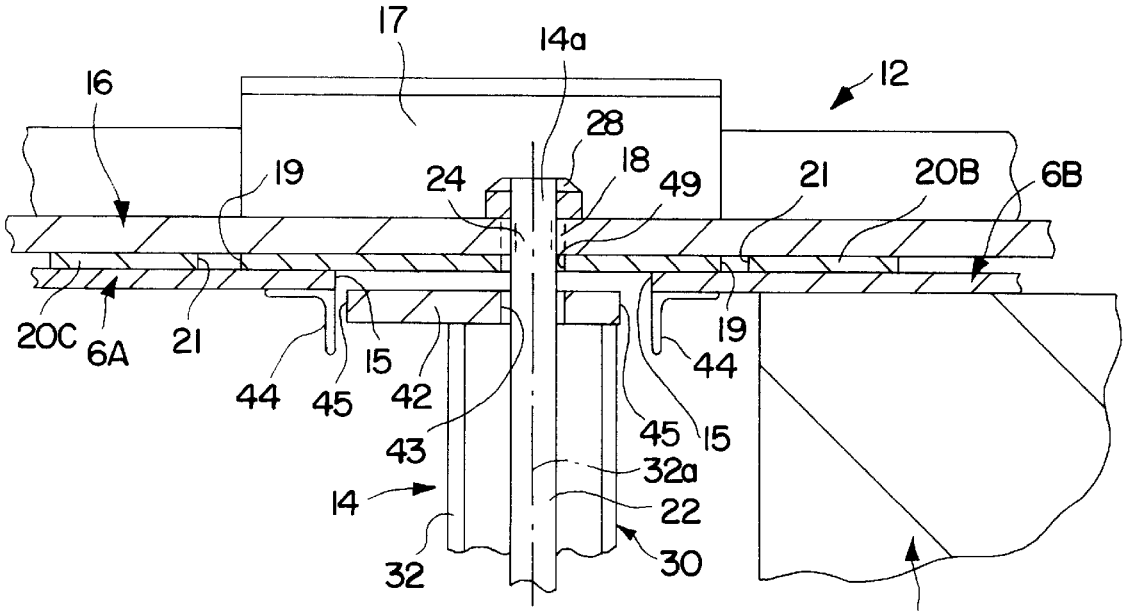
FIG. 5 is a greatly enlarged, broken-away view of a section of FIG. 4, showing a front end of a connective member.
Figure 6:
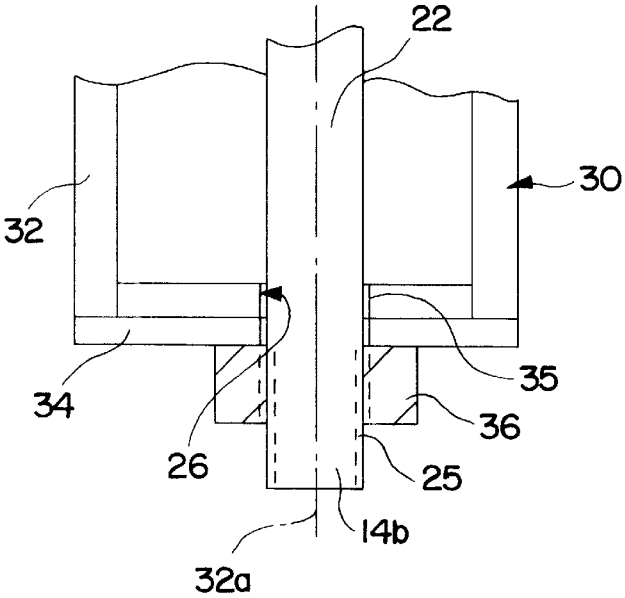
FIG. 6 is a greatly enlarged, broken-away view of a portion of FIG. 4, showing the rear end of the connective member.

Referring to FIGS. 4 and 5, the main screed 3 is preferably constructed of two screed halves 13A, 13B that are rotatable about a longitudinal centerline 1*b* of the screed assembly 1 (in order to have the capability of forming "crowns" in pavement mats). To enable the main screed halves 3A, 3B to rotate generally upwardly and toward each other, the inner vertical edges 15 of the two strike-off plates 6A, 6B are spaced from each other by a certain distance in order to prevent the plates 6A, 6B from rotating into contact with each other. To compensate for this gap between the plates 6A, 6B, the right strike-off plate 6B includes a gap-filler plate 17 attached to the front surface of the plate 6B and extending toward and overlapping the front surface of the left strike-off plate 6B, as best shown in FIG. 5. Besides performing the intended function of striking-off paving material at the centerline 1*b* of the screed assembly 1, the gap-filler plate 17 acts to prevent rotation of the preferred configuration of the retainer device 10, as discussed in further detail below.

Figure 7:
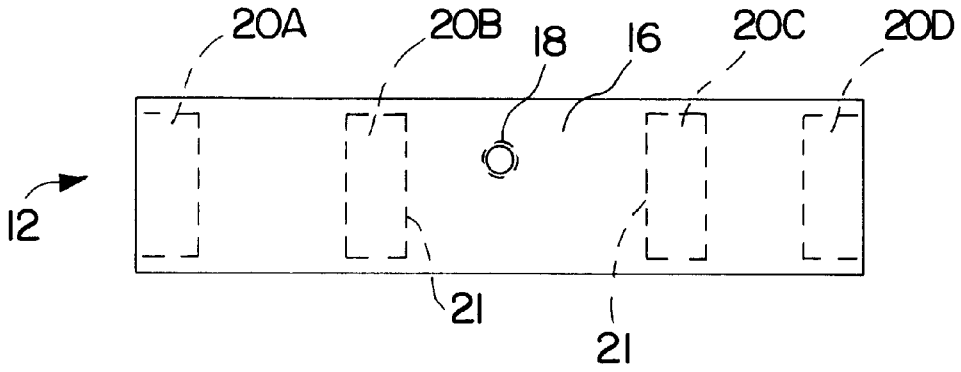
FIG. 7 is a front view of a retainer plate.
Figure 8:
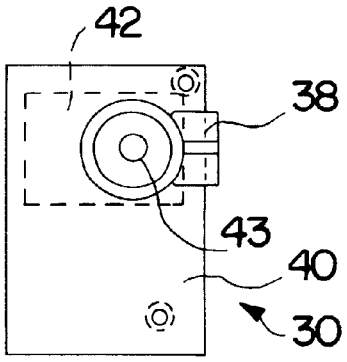
FIG. 8 is a rear view of a housing for the connective member.
Figure 9:
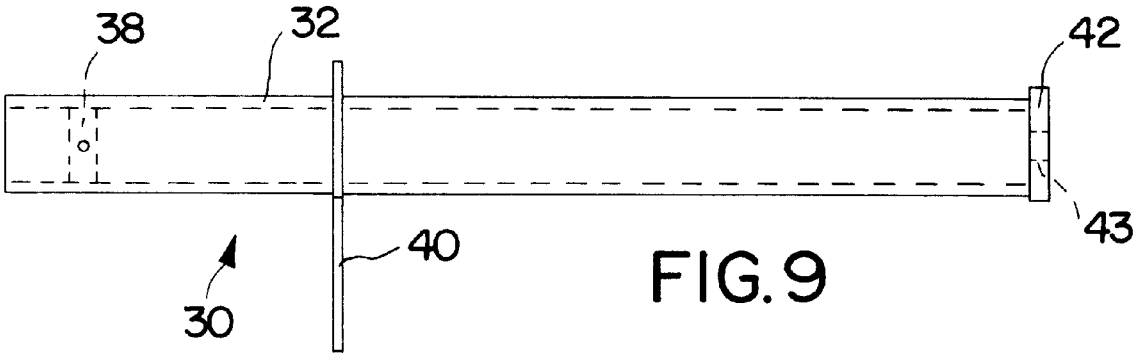
FIG. 9 is a side view of the housing of FIG. 8.

Referring to FIGS. 3–5 and 7, the retainer member 12 is preferably configured as a generally flat and generally rectangular plate 16, as best shown in FIG. 7. The plate 16 is disposed forwardly of the screed extensions 4 and strike-off plates 6A, 6B and extends across the gap-filler plate 17. Further, the plate 16 preferably includes a threaded hole 18 configured to engage with the first end 14*a* of the connective member 14, as discussed below. As best seen in FIG. 7, the retainer member 12 preferably includes four vertically-extending contact plates 20A–20D attached to the rear surface of the retainer plate 16, preferably by welding. The retainer device 10 is preferably configured such that the retainer member 12 contacts the strike-off plates 6A, 6B in both the first and second positions. In other words, the rear surface of each contact plate 20A–20D is preferably always disposed against the front surfaces of the proximal strike-off plate 6A or 6B. Alternatively, the retainer device 10 may be configured such that the retainer member 12 is spaced from strike-off plates 6A, 6B in the first position.

As best shown in FIG. 5, the two inner plates 20B, 20C are located on the retainer plate 16 such that the inner vertical edge 21 of each plate 20B, 20C is disposed proximal to the outer vertical edges 19 of the gap-filler plate 17. With this arrangement, the retainer plate 16 is substantially prevented from being pivoted by rotation of the connective member 14, as discussed below, as pivotal movement of plate 16 causes the edges 21 of the contact members 20B, 20C to abut into the side edges 19 of the filler plate 17. Although it is preferred to construct the retainer member 12 with the four contact plates 20A–20D, the retainer member 12 may be alternatively constructed with only the two inner contact plates 20B, 20C or without any contact plates, in which case the retainer plate 16 directly contacts the strike-off plates 6A, 6B.

Referring now to FIGS. 3–5, 8 and 9, the connective member 14 is preferably a rod 22 having the first end 14*a* movably engaged with the retainer member 12 and/or and the second end 14*b* movably engaged with the main screed 3. The rod 22 extends generally horizontally along the central longitudinal axis 1*b* (FIG. 4) of the screed assembly 1 and is preferably offset from the axis 1*b* toward the right main screed half 13B. The rod 22 is configured such that movement of the rod 22 in a first direction displaces the retainer member 12 from the first, most distal position to the second, most proximal position. Further, movement of the rod 22 in a second, opposing direction displaces the retainer member 12 from the second position to the first position.

Preferably, the first or front end 14*a* of the rod 22 extends through a clearance hole 49 in the gap-filler plate 17 and has a threaded portion 24 which is threadably engaged with the threaded hole 18 in the retainer plate 16. Further, a "jam" nut 28 is threadably engaged with the outer portion of the first rod end 14*a* and is disposed against the front surface of the plate 16. The nut 28 functions as a "jam" nut to fixedly attach the plate 16 to the first or front end of the rod 22. Further, the second end 14*b* of the rod 22 is preferably secured into a bearing surface 26 connected with the main screed 3, such that the rod 22 is thereby "slidably connected" with the main screed 3. In other words, the rod 22 is slidable alternately frontwardly and rearwardly in directions generally parallel with the longitudinal axis 1*b* of the screed assembly 1, to thereby displace the retainer member 12 in corresponding directions, as discussed below.

Preferably, the rod 22 extends through a hole 35 in a washer 34 attached to the end of a housing 30 (as described below), such that the hole 35 provides the bearing surface 26. The rod 22 has another threaded portion 25 proximal to the second end 14*b*. An actuating nut 36 is threadably engaged with the threaded portion 25. With this preferred structure, rotation of the actuating nut 36 causes the rod 22 to displace or slide alternately in opposing horizontal directions.

More specifically rotating the actuating nut 36 in a first direction (e.g., clockwise) causes the rod 22 to displace rearwardly with respect to the main screed 3. Rotating the actuating nut 36 in a second direction (i.e., counter-clockwise) causes the rod 22 to displace frontwardly with respect to the main screed 3. As the retainer plate 16 is attached to the rod 22, the retainer member 12 displaces in the same direction and by the same distance as the rod 22. Preferably, the actuating nut 36 is manually rotated using an appropriate device, such as a ratchet or a wrench (neither shown), although alternatively the retainer device 10 may be provided with automatic means for rotating the rod 22, such as for example, a belt-and-pulley drive or a chain-and-sprocket drive connected with an appropriate portion of the connective member 14.

Alternatively, the second end 14*b* of the rod 22 may be "rotatably connected" with the main screed 3. In other words, the rod 22 may be configured to be rotatable with respect to the main screed 3 but substantially prevented from displacing with respect to the main screed 3. Specifically, the first end of the rod 22 may be rotatably engaged with the threaded hole 18 in the retainer plate 16, such that rotation of the rod 22 displaces the retainer member 12 between the proximal position and the distal position, as described above, and vice-versa. More specifically, rotation of the rod 22 in a first direction (e.g., clockwise) causes the retainer member 12 to move generally toward the main screed 3 and the screed extensions 4. Further, rotation of the rod 22 in a second direction (i.e., counter-clockwise) causes the retainer member 12 to move generally away from the main screed 3 and the screed extensions 4.

Further, the connective member 14 be constructed in any other configuration that enables the member 14 to move the retainer member 12 alternately toward and away from the main screed 3. For example, the connective member 14 may be configured as the piston rod of a hydraulic cylinder (not shown), such that the connective member 14 is movably connected with the main screed 3 by attachment of the hydraulic cylinder body (not shown) to the main screed 3. Further for example, the connective member 14 may be a flexible connective element, such as for example, a cable, chain or belt, extending between the retainer member 12 and the main screed 3 and configured to displace the retainer member 12 between the two positions as described above. Therefore, the present invention embraces all appropriate configurations of the connective member 14 that are capable of moving the retainer member 12 alternately toward and away from the main screed 3.

Referring now to FIGS. 3–6, 8 and 9, the retainer device 10 preferably further includes a housing 30 that contains the connective member 14 and provides the bearing surface 26 and preferred means to connect the connective member 14 with the main screed 3. Further, the housing 30 also provides support for the strike-off plates 6A, 6B to prevent paving material from bending the lower portions of the plates 6A, 6B rearwardly during a paving operation. The housing 30 includes a tubular member 32 disposed about a substantial portion of the connective member 14 such that the rod 22 extends generally along the central axis 32*a* of the tubular member 32. The washer 34, as mentioned above, is preferably disposed against the rear end of the tubular member 32 in the manner of an "end cap".

Further, the housing 30 preferably includes a rear attachment lug 38 attached to the outer surface of the tubular member 32 near the rear end thereof and an attachment plate 40, through which a central portion of the tubular member 32 extends. The attachment lug 38 and the attachment plate 36 are each configured to connect the tubular member 32, and thus the connective member 14, to the main screed 3. More specifically, the lug 34 is preferably attached to a right vertical side wall 3*c* of the main screed 3 and the attachment plate 40 is preferably attached to the front surface 3*a* of the main screed 3, both preferably by means of threaded fasteners (not shown). Further, the housing 30 also preferably includes a stop plate 42 attached to the front end of the tubular member 32, the connective member rod 22 extending through a clearance hole 43 in the plate 42. The stop plate 42 has vertically-extending side edges 45 that are configured to contact with vertically-extending stops 44 attached to the inner edge of each strike-off plate 6A, 6B. The arrangement of the stop plate 42 and stops 44 prevents the housing 30, and thus the connective member 14, from being bended laterally toward either side of the screed assembly 1.

Although the retainer device 10 preferably includes the housing 30 as described above, it is within the scope of the present invention to construct the above-described retainer device 10 without any such housing. For example, the device 10 may alternatively include a bearing block (not shown) attached to the main screed 3 and through which the second end 14*b* of the connective member rod 22 is extended to rotatably connect the connective member 14 with the main screed 3. However, if the retainer device 10 were constructed without a housing, the screed assembly 1 should be provided with another device to prevent rearward bending of the strike-off plates 6A, 6B, such as for example a "snubber bar" (not shown).

With the preferred configuration of the connective member 14, the retainer device 10 functions in the following manner. Rotation of the actuating nut 36 causes the rod 22 to slidably displace within the bearing surface 26, and thereby displace the attached retainer member 12 between the proximal position and the distal position, as described above, and vice-versa. More specifically, rotation of the actuating nut 36 in a first direction (e.g., clockwise) causes the retainer member 12 to move generally toward the main screed 3 and the screed extensions 4. Further, rotation of the actuating nut 36 in a second direction (i.e., counter-clockwise) causes the retainer member 12 to move generally away from the main screed 3 and the screed extensions 4.

As is apparent from the above description and FIGS. 4 and 5, rotation of the actuating nut 36 at the second or rear end 14*b* of the rod 22 does not cause the rod 22 to rotate since the plate 16, attached at the front end 14*a* of the rod 22, is prevented from pivoting by the above-described arrangement of the contact plates 20B, 20C. More specifically, any pivoting of the plate 16 will cause the edges 21 of the contact plates 20B, 20C to impact with outer vertical edges 19 of the gap-filler plate 17, such that the any further pivoting or rotation of the retainer member 12 is thereby prevented. Thus, the connected rod 22 is thereby also prevented from being rotated.

Therefore, rotating or turning the actuating nut 36 causes the nut 36 to either "push" or "pull" the rod 22 at the engaged threaded portion 25 thereof, such that the rod 22 thereby displaces alternately in opposing horizontal directions with respect to the main screed 3. Further, the connected retainer plate 16 thereby alternately displaces toward and away from the main screed 3, and thus also toward and from the screed extensions 4.

Further, with the preferred structure of the screed assembly 1, the retainer device 10 acts upon the screed extension 4 through the strike-off plates 6A, 6B. More specifically, the contact plates 20–20D are preferably always disposed against the front surface of the proximal strike-off plates 6, although alternatively the plates 20A–20D move into contact with the strike-off plates 6A, 6B during movement toward the most proximal position. In either case, when the connective member 14 displaces or "pulls" the retainer member 12 such that the member 14 displaces in the direction toward the main screed 3, the retainer member 12, through the contact plates 20A–20D, pushes against the outer surfaces of the strike-off plates 6A, 6B such that the plates 6A, 6B displace toward the main screed 3.

Further, the movement of the strike-off plates 6A, 6B toward the main screed 3 causes the plates 6A, 6B to move into contact with the screed extensions 4 when the screed extensions 4 are in retracted positions (e.g., right side of FIG. 5). Thus, the retainer member 12 acts to retain the screed extensions 4 proximal to the front vertical surface 3*a* of the main screed 3 by transmitting force through the strike-off plates 6A, 6B and to the screed extensions 4 so as to move the screed extensions 4 toward the main screed 3. However, the screed assembly 1 may alternatively be constructed without any strike-off plates (although not preferred), in which case the retainer member 12 acts directly upon the front surface 4*b* of the screed extensions 4 (i.e., when in retracted positions).

Preferably, at the second, proximal position of the retainer member 12, the inner end 4*b* of each screed extension 4 is "sandwiched" between the retainer member 12 (through the strike-off plates 6A, 6B) and the main screed 3, with the rear vertical surface 4*a* of the screed extension 4 being disposed substantially against the front surface 3*a* of the main screed 3. Further, the connective member 14 may pull the retainer member 12 with sufficient rearward force so that the screed extensions 4 contact the main screed 3 with a contact or "normal" force. Alternatively, there may be a space or separation between the rear surface 4*a* of the screed extensions 4 and the front surface 3*a* of the main screed 3, as long as the screed extensions 4 are maintained sufficiently proximal to the main screed 3 such that the screed extensions 4 are substantially prevented from pivoting forwardly about the pivot points P (FIG. 3).

Alternatively to the preferred structure described above, the retainer device 10 may be configured with the connective member 14 being substantially non-movable or "fixed", such that the retainer member 12 is disposed at a fixed location with respect to the main screed 3. For example, the connective member 14 may be configured as a pole or cantilever beam having a rear end fixedly attached to the main screed 3, with the retainer plate 16 being non-movably attached to a front end of the pole/beam. While such a retainer device 10 does function to retain the screed extensions 4 proximal to the main screed 3, so as to prevent excessive rotation frontwardly about the pivot points P, this configuration is generally not preferred as it typically has one of the following limitations. The retainer member 12 may be positioned too far from the main screed 3, such that the screed extensions 4 remain pivotable to a certain extent forwardly about the points P. Alternatively, the retainer member 12 may be positioned too close to the main screed 3 such that the rear surface 4*a* of each screed extension 4 always contacts the front surface 3*a* of the main screed 3, which may interfere with lateral movement of the screed extensions 4 and lead to wearing of the screed surfaces 3*a*, 4*a*.

It is apparent that the retainer device 10 of the present invention provides a screed assembly 1 with a number of advantages. Prior to transporting the screed assembly 1, the retainer device 10 may be used to retain the screed extensions 4 against the main screed 3, such that the screed extensions 4 are prevented from swinging relative to the main screed 3 and causing damage as described above. Once the paver machine is at a work-site, the retainer device 10 is easily operated, i.e., by turning the actuating nut 36, so that the screed extensions 4 are once again fully movable with respect to the main screed 3.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A retainer device for a screed assembly including a main screed and a front-mounted screed extension connected with the main screed, the screed extension having a front surface facing generally away from the main screed, the retainer device comprising:

a retainer member disposed adjacent to the front surface of the screed extension;

a connective member having a first end connected with the retainer member and a second end connected with the main screed and configured to displace the retainer member between a first, most distal position with respect to the main screed and a second, most proximal position with respect to the main screed where the retainer member acts upon the screed extension such that the screed extension is retained generally in contact with the main screed.

2. The retainer device as recited in claim 1 wherein the connective member is a rod having at least one of a first end movably engaged with the retainer member and a second end movably engaged with the main screed, and movement of the rod in a first direction displaces the retainer member from the first position to the second position and movement of the rod in a second, opposing direction displaces the retainer member from the second position to the first position.

3. The retainer member as recited in claim 1 wherein the retainer member has a threaded hole, the first end of the rod is threadably engaged with the threaded hole of the retainer member, the second end of the rod is rotatably connected with the main screed and rotation of the rod displaces the retainer member between the proximal position and the distal position.

4. The retainer device as recited in claim 1 wherein the retainer member is configured as a plate.

5. The retainer device as recited in claim 1 wherein the screed assembly further includes a strike-off plate connected with one of the main screed and the screed extension and the retainer member contacts the strike-off plate in the second position such that force is transmitted from the retainer member, through the strike-off plate and to the screed extension.

6. The retainer device as recited in claim 1 wherein the retainer member applies force to the screed extension when the retainer member is disposed in the second position.

7. The retainer device as recited in claim 1 wherein the screed extension is laterally displaceable with respect to the main screed when the retainer member is disposed in the first position.

8. A retainer device for a screed assembly including a main screed and a front-mounted screed extension pivotally attached to the main screed and having a front surface facing generally away from the main screed, the retainer device comprising;

a horizontally-extending rod having a rear end connected with the main screed and a front end; and a plate connected with the front end of rod and disposed adjacent to the front surface of the screed extension such that the plate prevents rotation of the screed extension in a direction generally away from the main screed.

9. The retainer device as recited in claim 8 wherein the rod is configured to displace the plate between a first, most distal position with respect to the main screed and a second, most proximal position with respect to the main screed where the retainer member acts upon the screed extension such that the screed extension is retained generally in contact with the main screed.

10. The retainer device as recited in claim 9 wherein at least one of the front end of the rod is movably engaged with the plate and the rear end of the rod is movably engaged with the main screed, and movement of the rod in a first direction displaces the plate from the first position to the second position and movement of the rod in a second, opposing direction displaces the retainer member from the second position to the first position.

11. The retainer device as recited in claim 8 wherein the plate has a threaded hole, the front end of the rod is threadably engaged with the threaded hole of the plate, the rear end of the rod is rotatably connected with the main screed and rotation of the rod displaces the retainer member between a proximal position and the distal position.

* * * * *